US010096959B2

(12) United States Patent
Susini et al.

(10) Patent No.: US 10,096,959 B2
(45) Date of Patent: Oct. 9, 2018

(54) FEMALE ELECTRICAL CONNECTOR, CORRESPONDING MALE ELECTRICAL CONNECTOR AND CONNECTION ASSEMBLY COMPRISING MALE AND FEMALE CONNECTORS

(71) Applicant: SAGEMCOM BROADBAND SAS, Rueil Malmaison (FR)

(72) Inventors: Dominique Susini, Rueil Malmaison (FR); Daniel Siron, Rueil Malmaison (FR); Nicolas Dangy-Caye, Rueil Malmaison (FR); Radu Nedelcu, Rueil Malmaison (FR)

(73) Assignee: SAGEMCOM BROADBAND SAS, Rueil Malmaison (FR)

( * ) Notice: Subject to any disclaimer, the term of this patent is extended or adjusted under 35 U.S.C. 154(b) by 0 days.

(21) Appl. No.: 15/037,574

(22) PCT Filed: Dec. 2, 2014

(86) PCT No.: PCT/EP2014/076319
§ 371 (c)(1),
(2) Date: May 18, 2016

(87) PCT Pub. No.: WO2015/082504
PCT Pub. Date: Jun. 11, 2015

(65) Prior Publication Data

US 2016/0294135 A1 Oct. 6, 2016

(30) Foreign Application Priority Data

Dec. 5, 2013 (FR) ..... 13 62213

(51) Int. Cl.
*H01R 31/00* (2006.01)
*H01R 27/02* (2006.01)
(Continued)

(52) U.S. Cl.
CPC ..... *H01R 27/02* (2013.01); *H01R 13/64* (2013.01); *H01R 24/20* (2013.01); *H01R 24/62* (2013.01);
(Continued)

(58) Field of Classification Search
CPC ..... H01R 23/02; H01R 31/00; H01R 31/06; H01R 33/7664; H01R 33/7685
(Continued)

(56) References Cited

U.S. PATENT DOCUMENTS 3,275,765 A * 9/1966 Ferdon ..... H01R 13/7032 200/50.28
5,454,737 A * 10/1995 Saba ..... H01R 31/00 439/350

(Continued)

*Primary Examiner* — Abdullah Riyami
*Assistant Examiner* — Vladimir Imas
(74) *Attorney, Agent, or Firm* — Muncy, Geissler, Olds & Lowe, P.C.

(57) ABSTRACT

A female electrical connector having a plug defining a connection recess for accommodating a male plug of a complementary male electrical connector and within which contacts are arranged in accordance with the HDMI standard. The female electrical connector further has mechanical securing means suitable for preventing the connection of a standard male HDMI connector to said female electrical connector. A male electrical connector, a combined electrical connector, and a connection assembly having a female electrical connector and a male electrical connector are also provided.

13 Claims, 2 Drawing Sheets

(51) Int. Cl.

| | |
|---|---|
| ***H01R 13/64*** | (2006.01) |
| ***H01R 24/62*** | (2011.01) |
| ***H01R 24/20*** | (2011.01) |
| ***H01R 24/64*** | (2011.01) |
| *H01R 103/00* | (2006.01) |
| *H01R 107/00* | (2006.01) |

(52) U.S. Cl.
CPC ..... *H01R 24/64* (2013.01); *H01R 2103/00* (2013.01); *H01R 2107/00* (2013.01)

(58) Field of Classification Search
USPC ..... 439/655, 638
See application file for complete search history.

(56) References Cited

U.S. PATENT DOCUMENTS 6,755,689 B2 * 6/2004 Zhang ..... H01R 12/716 439/357
6,843,677 B2 * 1/2005 Fukuda ..... H01R 33/7664 439/374
6,929,487 B1 * 8/2005 Raghavendra ..... H01R 13/6658 439/654
6,935,896 B1 * 8/2005 Tsai ..... H01R 13/506 439/541.5
6,986,681 B2 * 1/2006 Tsai ..... H01R 23/6873 439/607.36
7,059,914 B2 * 6/2006 Tsai ..... H01R 24/60 439/417
7,108,566 B2 * 9/2006 Kressmann ..... H01R 13/193 439/701
7,578,705 B2 * 8/2009 He ..... H01R 13/514 439/660
7,594,827 B2 * 9/2009 Takamoto ..... A63F 13/02 439/353
7,651,379 B1 * 1/2010 Wu ..... H01R 12/62 439/108
7,794,269 B2 * 9/2010 Chin ..... H01R 13/641 439/489
7,878,833 B2 * 2/2011 Chen ..... H01R 13/5045 439/284
7,942,702 B2 * 5/2011 Chang ..... H01R 13/514 439/541.5
8,162,691 B2 * 4/2012 Chang ..... H01R 12/724 439/541.5
8,206,177 B2 * 6/2012 Chang ..... H01R 13/502 439/607.35
8,403,702 B2 * 3/2013 Lopes ..... H01R 31/06 439/595
8,517,772 B2 * 8/2013 Wu ..... H01R 24/62 439/501
8,517,773 B2 * 8/2013 Lee ..... H01R 12/716 439/660
8,579,519 B2 * 11/2013 Wu ..... G02B 6/3817 385/101
8,672,714 B2 * 3/2014 Wu ..... H01R 31/06 439/638
8,870,606 B2 * 10/2014 Yu ..... H01R 9/031 439/701
8,905,653 B2 * 12/2014 Wu ..... G02B 6/3817 385/93
8,968,031 B2 * 3/2015 Simmel ..... H01R 13/659 439/108
9,048,563 B2 * 6/2015 Miura ..... H01R 12/81
9,093,798 B2 * 7/2015 Locker ..... H01R 12/724
9,190,781 B2 * 11/2015 Chang ..... H01R 13/6683
9,431,767 B2 * 8/2016 Wu ..... H01R 13/6463
9,472,911 B2 * 10/2016 Little ..... H01R 24/60
9,490,581 B2 * 11/2016 Ng ..... H01R 13/646
2002/0072275 A1 6/2002 Arai
2006/0240715 A1 * 10/2006 Zueck ..... H01R 13/6456 439/681
2008/0119291 A1 * 5/2008 Takamoto ..... A63F 13/02 463/47
2009/0186519 A1 * 7/2009 Chin ..... H01R 13/641 439/489
2009/0186527 A1 * 7/2009 Hardell ..... H01R 13/6471 439/633
2010/0267282 A1 * 10/2010 Tsai ..... H01R 23/10 439/607.17
2012/0114288 A1 5/2012 Wu
2012/0282814 A1 * 11/2012 Houdek ..... H01R 25/00 439/650
2013/0189880 A1 * 7/2013 Wang ..... H01R 13/7031 439/660
2014/0065869 A1 * 3/2014 Xu ..... H01R 13/629 439/345
2014/0194008 A1 * 7/2014 Locker ..... H01R 12/724 439/638
2014/0370759 A1 * 12/2014 Tai ..... H01R 12/724 439/629
2015/0171562 A1 * 6/2015 Gao ..... H01R 13/6582 439/345
2015/0364864 A1 * 12/2015 Wang ..... H01R 13/629 439/607.01

* cited by examiner

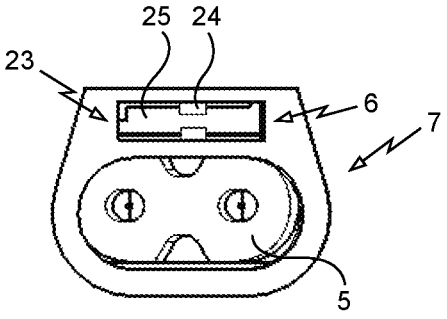
Fig. 3
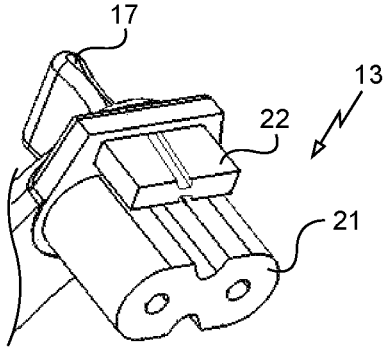
Fig. 4
Fig. 5a
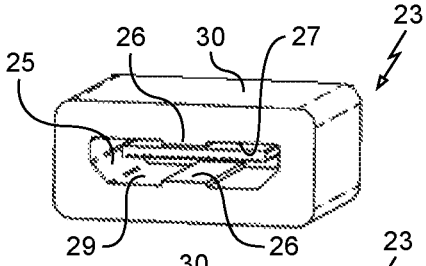
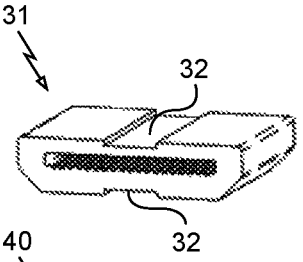
Fig. 5b
Fig. 6a
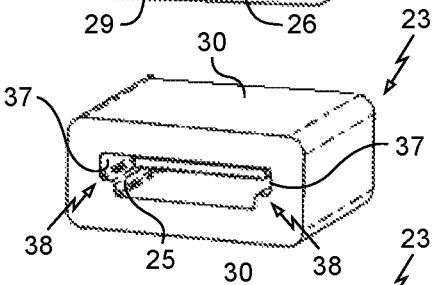
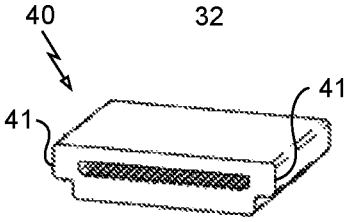
Fig. 6b
Fig. 7a
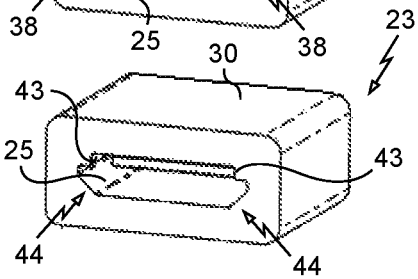
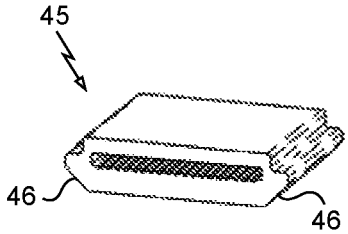
Fig. 7b
Fig. 8a
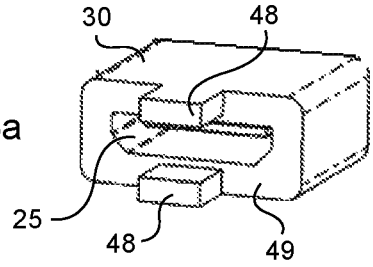
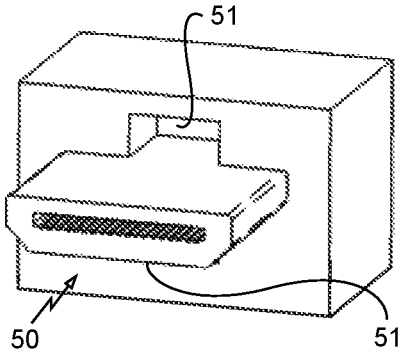
Fig. 8b

FEMALE ELECTRICAL CONNECTOR, CORRESPONDING MALE ELECTRICAL CONNECTOR AND CONNECTION ASSEMBLY COMPRISING MALE AND FEMALE CONNECTORS

The invention relates to a female electrical connector including safety means adapted to prevent a standard male HDMI connector connecting with said female electrical connector. The invention also relates to a male electrical connector that is complementary to said female electrical connector, to a combined electrical connector, and to a connection assembly comprising a female electrical connector and a male electrical connector.

BACKGROUND OF THE INVENTION

Certain home electrical installations require a plurality of pieces of electrical equipment or modules to be connected together. Such installations include a "multimedia installation" e.g. combining an Internet gateway, a TV decoder, a video game console, etc. It is also possible to mention a "Hi-Fi" audio installation, e.g. combining an amplifier, a CD deck, a tuner, etc.

Numerous electric cables are used in installations of this type for connecting each electrical module to a mains electricity outlet, for connecting one or more electrical modules to the Internet, for connecting the modules to one another so as to enable data to be exchanged between the modules, etc.

The use of numerous cables raises certain problems. In particular, connecting the various electrical modules to one another is relatively complex and can present difficulties for an inexperienced user.

OBJECT OF THE INVENTION

An object of the invention is to provide a female electrical connector adapted to be mounted on an electrical module of an electrical installation of the kind mentioned above, with the use of said connector serving to simplify connection of the module in the installation.

SUMMARY OF THE INVENTION

In order to achieve this object, there is provided a female electrical connector comprising a female plug defining a connection housing for receiving a male plug of a complementary male electrical connector and within which the contacts are arranged in compliance with the HDMI standard. According to the invention, the female electrical connector further includes mechanical safety means adapted to prevent a standard male HDMI connector being connected to said female electrical connector.

By fitting an electrical module of a home electrical installation with a female electrical connector of the invention, the quality of data transmission within the installation benefits from the HDMI standard, while any connection of the electrical module with an electric cable provided at one of its ends with a standard male HDMI connector is prevented. This reduces the number of cables in the installation that might be connected erroneously with the electrical module, thereby simplifying the connection of said module in the installation.

There is also provided a female electrical connector as described above, wherein the mechanical safety means are defined by an inside shape of the connection housing.

Furthermore, there is provided a female electrical connector as described above, wherein the inside shape of the connection housing presents at least one spline situated on at least one inside face of the connection housing.

Additionally there is provided a female electrical connector as described above, wherein the inside shape of the connection housing presents a first spline situated at the center of a bottom inside face of the connection housing and a second spline situated at the center of a top inside face of the connection housing.

The invention also provides a female electrical connector as described above, wherein the connection housing is defined by a side wall in which there is arranged at least one slot extending in a direction for inserting the male plug of the corresponding male electrical connector into the housing.

The invention also provides a female electrical connector as mentioned above, wherein the housing has an inside shape that is T-shaped with a central portion constituted by the slot.

The invention also provides a female electrical connector as described above, wherein the mechanical safety means include at least one protuberance projecting from a surface of the female plug.

There is also provided a male electrical connector complementary to the female electrical connector as described above.

There is also provided a combined electrical connector comprising a first male electrical connector for conveying an electrical power supply and a second male electrical connector for conveying digital data, the second male electrical connector being in accordance with that described above.

There is also provided a combined electrical connector as described above, wherein the first male electrical connector is a standard power supply connector.

There is also provided a combined electrical connector as mentioned above, wherein the first male electrical connector is a male connector of type C7 in compliance with the IEC standard.

Finally, the invention provides a connection assembly comprising a female electrical connector as described above and a male electrical connector or a combined electrical connector as described above.

The invention can be better understood in the light of the following description of a particular, non-limiting embodiment of the invention.

BRIEF DESCRIPTION OF THE DRAWINGS

Reference is made to the accompanying drawings, in which:

FIG. 3 shows a first electrical connector including the female electrical connector of the invention;

FIG. 4 shows a second electrical connector complementary to the first electrical connector of FIG. 3;

FIG. 5*a* shows a female plug of a female electrical connector of the invention in a first embodiment;

FIG. 5*b* shows a male plug of link means complementary to the female plug shown in FIG. 5*a;*

FIG. 6*a* shows a female plug of a female electrical connector of the invention in a second embodiment;

FIG. 6*b* shows a male plug of link means complementary to the female plug shown in FIG. 6*a;*

FIG. 7*a* shows a female plug of a female electrical connector of the invention in a third embodiment;

FIG. 7*b* shows a male plug of link means complementary to the female plug shown in FIG. 7*a;*

FIG. 8*a* shows a female plug of a female electrical connector of the invention in a fourth embodiment; and FIG. 8*b* shows a male plug of link means complementary to the female plug shown in FIG. 8*a.*

DETAILED DESCRIPTION OF THE INVENTION

Figure 1:
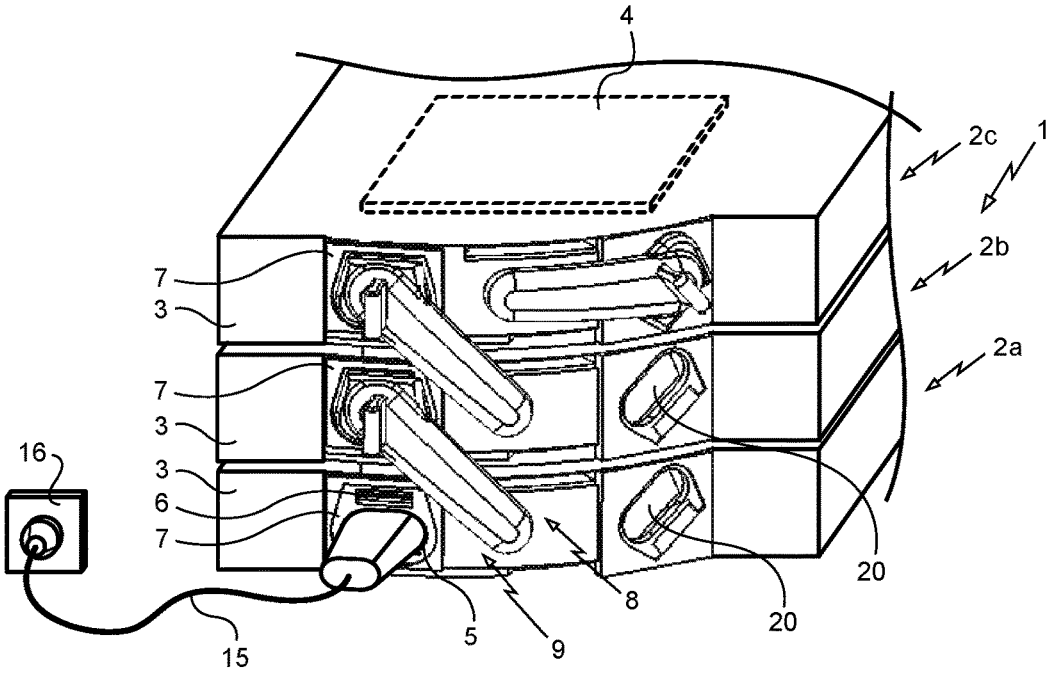
FIG. 1 is a perspective view of three electrical modules, each fitted with a female electrical connector of the invention.

With reference to FIG. 1, the invention is illustrated by a home electrical installation 1 comprising first, second, and third electrical modules 2*a*, 2*b*, and 2*c* of the invention. In the context of a multimedia installation, it can comprise, by way of example: a home Internet gateway; a television decoder; and a video game console; said multimedia installation then also including a TV set (not shown) connected to the above-mentioned electrical modules.

Each of the electrical modules 2 is adapted to operate by being connected or not connected to another electrical module of the same type. The term "same type" is used to mean that the electrical modules possess compatible electrical interfaces and are adapted to co-operate so that together they perform at least one particular function. Thus, once more in the context of a multimedia installation, the video game console can operate independently but it can also be connected to the home gateway in order to receive data from the Internet, e.g. for interacting with other players.

Each electrical module 2 comprises a box 3 containing at least one electrical card 4 adapted to perform functions specific to the electrical module 2 and possibly particular functions resulting from co-operation between modules, if any.

First connection means 5 and second connection means combined in a single first electrical connector 7, specifically a female connector, and link means 8 are arranged on each box 3.

The first connection means 5 are for connecting the electrical module to a power supply that is external to the module in question. The term "external power supply" is used interchangeably to cover a power supply coming from a mains electricity outlet and a power supply coming from another electrical module 2.

The second connection means 6 enable the electrical module 3 to exchange first data externally relative to the electrical module 3. The term "externally relative to the electrical module" is used herein to mean that first data is exchanged with any piece of equipment or with some other electrical module 2.

Figure 2:
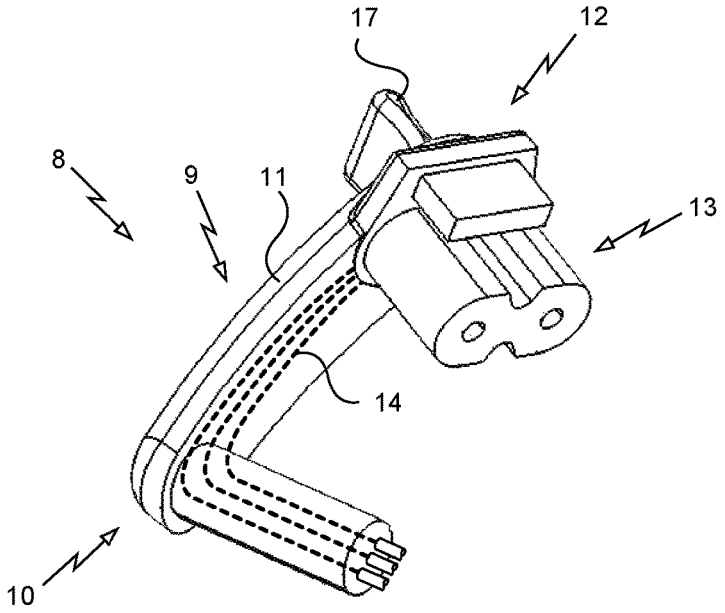
FIG. 2 shows the link means for connecting together two electrical modules.

The link means 8 comprise an arm 9 that can be seen more clearly in FIG. 2, which itself has a first end 10 fastened to the box 3, a body 11, a second end 12 having a male second electrical connector 13 complementary to the first electrical connector 7, and a grip zone 17 situated on the second end 12. Electric cables 14 connecting the first end 10 with the second electrical connector 13 pass inside the body 11 of the arm 9.

The first electrical connector 7 and the arm 9 of the electrical modules 3 are thus used firstly to provide a power supply for the three electrical modules 2 of the home electrical installation, and secondly to exchange link data between the three electrical modules 2.

There follows a description in greater detail of how the first electrical module 2*a*, the second electrical module 2*b*, and the third electrical module 2*c* are electrically connected together.

The first electrical module 2*a* is connected via the first connection means 5 of the first electrical connector 7 of the first electrical module 2*a* and via a standard power supply cable 15 to a mains electricity outlet 16. The electrical card 4 of the first electrical module 2*a* has a power supply circuit that is thus powered by the voltage from the mains electricity outlet 16. The power supply circuit of the electrical card 4 of the first electrical module 2*a* provides one or more power supplies for the remainder of the electrical card 4 and also a link power supply to the second module 2*b* via the arm 9 of the first electrical module 2*a*, said link power supply being adapted to power the electrical card 4 of the second electrical module 2*b*.

Furthermore, the electrical card 4 of the electrical module 2*a* and the electrical card 4 of the electrical module 2*b* exchange link data via the arm 9 of the first electrical module 2*a*. The second electrical connector 13 of the arm 9 of the first electrical module 2*a* is connected for this purpose to the first electrical connector 7 of the second electrical module 2*b*.

The second electrical module 2*b* is thus powered by the first electrical module 2*a*, and it is adapted to exchange link data with the first electrical module 2*a*.

The second electrical module 2*b* is also connected to the third electrical module 2*c*. The electrical card 4 of the second electrical module 2*b* provides a link power supply to the third electrical module 2*c* via the arm 9 of the second electrical module 2*b*. The electrical card 4 of the second electrical module 2*b* and the electrical card 4 of the third electrical module 2*c* also exchange link data via the arm 9 of the second electrical module 2*b*. The second electrical connector 13 of the arm 9 of the second electrical module 2*b* is connected for this purpose to the first electrical connector 7 of the third electrical module 2*c*.

The third electrical module 2*c* is thus powered by the second electrical module 2*b*, and it is adapted to exchange link data with the second electrical module 2*b*.

Thus, the link data exchanged between the first electrical module 2*a* and the third electrical module 2*c* transits via the second electrical module 2*b*.

It should thus be observed that the arms 9 of the first electrical module 2*a* and of the second electrical module 2*b* are respectively connected to the second electrical module 2*b* and to the third electrical module 2*c*, whereas the arm 9 of the third electrical module 2*c* is not used. The term "connection position" is used to designate the position occupied by the arms 9 of the electrical modules 2*a* and 2*b*, which are connected to another electrical module, and the term "rest position" is used to designate the position occupied by the arm 9 of the third module 2*c*, which is not connected to another electrical module.

Each box 3 of an electrical module 2 has a dummy female electrical connector 20 complementary to the second electrical connector 13 and adapted to receive the second electrical connector 13 when the arm is positioned in its rest position. The first end 10 of the arm 9 is pivotally mounted on the box 3 so that a user can selectively position the arm 9 in the connection position or in the rest position by taking hold of the grip zone 17 by hand and pivoting the arm.

The arm 9 presents a length that is short but sufficient to interconnect electrically any two modules 2 that might be incorporated in the installation 1, regardless of the height of said modules 2.

In this example the arm 9 is secured to the box 3 of the electrical module 2 and cannot be removed. Alternatively, provision could be made for an arm 9 that is releasably fastened to the box 3 so as to be separable from the box 3 and possibly mounted on some other electrical module 2.

There follows a description in greater detail of the first electrical connector 7 of an electrical module 2 and the second electrical connector 13 of an arm 9, with reference to FIGS. 3 and 4.

The first electrical connector 7 is a female connector combining the first connection means 5 suitable for conveying a power supply, and the second connection means 6 suitable for conveying digital data. The second electrical connector 13 is a male connector complementary to the first connector and it has third connection means 21 complementary to the first connection means 5 and fourth connection means 22 complementary to the second connection means 6 of the electrical module 2.

The electrical connector 13 is oriented relative to the arm 9 as a function of the angle made by the arm 9 when it is interconnecting two modules 2.

The first connection means 5 of the first connector 7 comprise a standard female electrical power supply connector of type C7 complying with the IEC 60320-1standard. The third connection means 21 of the second electrical connector 13 thus comprise a standard male electrical power supply connector of type C7 in compliance with the IEC 60320-1 standard. Thus, an electrical module 2 can equally well be powered from a mains electricity outlet via an electric cable having a male electrical connector at its free end in compliance with the above-mentioned standards, as shown for the first electrical module 2*a*, or by another electrical module, as shown for the second and third electrical modules 2*b* and 2*c*.

The second connection means 6 of the first electrical connector 7 comprise a non-standard female electrical connector 23 of the invention, said female electrical connector 23 having mechanical safety means 24 so as to be capable of being connected solely to an arm 9 of another electrical module. The first data exchanged externally by each electrical module via the arm 9 is constituted solely by link data coming from another module.

The female electrical connector 23 of the second connection means comprise a female plug 30 defining a connection housing 25 within which contacts are arranged in compliance with the HDMI standard.

The mechanical safety means are adapted to prevent a standard HDMI male connector connecting with the female electrical connector 23. Thus, a user cannot in error connect a standard HDMI connector coming from equipment of some other type (e.g. a camcorder) to the female electrical connector 23 of an electrical module 2.

With reference to FIG. 5*a*, the mechanical safety means 24 are defined by an inside shape of the connection housing 25, which inside shape presents at least one spline 26 situated on at least one inside surface of the connection housing. Specifically, the inside shape of the connection housing 25 presents a first spline 26 situated at the center of a top inside face 27 of the connection housing and a second spline 26 situated at the center of a bottom inside face 29 of the connection housing 25.

When the female electrical connector 23 includes the mechanical safety means 24 of the first embodiment, the fourth connection means 22 include a male plug 31, shown in FIG. 5*b* that is complementary to the female plug in question, i.e. a male plug having contacts arranged in compliance with the HDMI standard, and with an outside shape that presents two slots 32 complementary to the splines 26 of the connection housing 25 of the female plug 30 of the female electrical connector 23.

In the second embodiment shown in FIG. 6*a*, the mechanical safety means 24 are defined by an inside shape of the connection housing 25 that is defined by two side walls 37, each provided with a spline of square or rectangular section 38 extending in a direction for inserting the male plug of the corresponding male electrical connector into the housing. The male plug 40 of the fourth connection means 22 then includes complementary slots 41 of square or rectangular section arranged to receive the splines 38.

In a third embodiment, shown in FIG. 7*a*, the connection housing 25 is defined by two side walls 43, each of which has a slot of triangular section 44 formed therein. The male plug 45 of the fourth connection means then has complementary splines 46 of triangular section.

In a fourth embodiment, shown in FIG. 8*a*, the mechanical safety means 24 comprise at least one protuberance 48 projecting from a front face 49 of the female plug 30 in order to extend parallel to the direction for engaging the male plug 50 in the female plug 30. Specifically, the female plug 30 has two protuberances 48 situated on either side of the connection housing 25. The male plug 50 of the fourth connection means 22 then has two reception housings 51 complementary to the protuberances 48. These protuberances 48 are of a length that is sufficient to enable no more than partial insertion of a standard HDMI male plug into the female plug of the female electrical connector, while preventing any electrical connection between the contacts of those two plugs.

The invention is not limited to the particular embodiments described above, but on the contrary covers any variant coming within the ambit of the invention as defined by the claims.

The box of the electrical module may naturally include other connection means enabling the electrical module to be connected to an external power supply or to some other equipment. In particular, the box may include a standard additional connector arranged on the box and enabling the electrical module to exchange second data externally, said additional connector being, for example, a standard connector giving access to the Internet via a standard cable.

The second connection means may be of standards other than the HDMI standard, and for example they may be of the USB, Firewire, etc. standards.

The arm may be telescopic and the connection means 21 and 22 may be mounted on swivel supports.

The link data may be sent by the electrical module 2*a* for the attention of the electrical module 2*c*, in which case it merely transits via the electrical module 2*b*, or it may be sent by the electrical module 2*b* for the attention of the electrical module 2*c*.

The invention claimed is:

1. A female electrical connector comprising a female plug defining a connection housing for receiving a male plug of a complementary male electrical connector and within which the contacts are arranged in compliance with the HDMI standard, the female electrical connector further includes mechanical safety means mechanically blocking a male electrical connector in compliance with the HDMI standard but without a complementary mechanical safety means from mechanically connecting with said female electrical connector, the mechanical safety means including at least one protuberance projecting from a surface of the female plug, said surface being orthogonal to a direction for inserting the male plug of the complementary male electrical connector into the housing.

2. The female electrical connector according to claim 1, including an additional mechanical safety means defined by an inside shape of the connection housing.

3. The female electrical connector according to claim 2, wherein the inside shape of the connection housing presents at least one spline situated on at least one inside face of the connection housing.

4. The female electrical connector according to claim 3, wherein the inside shape of the connection housing presents a first spline situated at the center of a bottom inside face of the connection housing and a second spline situated at the center of a top inside face of the connection housing.

5. The female electrical connector according to claim 2, wherein the connection housing is defined by a side wall in which there is arranged at least one slot extending in the direction for inserting the male plug of the complementary male electrical connector into the housing.

6. The female electrical connector according to claim 5, wherein the housing has an inside shape that is T-shaped with a central portion constituted by the slot.

7. A male electrical connector complementary to the female electrical connector according to claim 1.

8. A combined electrical connector comprising a first male electrical connector for conveying an electrical power supply and a second male electrical connector for conveying digital data, the second male electrical connector being in accordance with claim 7.

9. The combined electrical connector according to claim 8, wherein the first male electrical connector is a standard power supply connector.

10. The combined electrical connector according to claim 8, wherein the first male electrical connector is a male connector of type C7 in compliance with the IEC standard.

11. A connection assembly comprising the female electrical connector according to claim 1 and a male electrical connector complementary to the female electrical connector.

12. A connection assembly comprising the combined electrical connector of claim 8.

13. The female electrical connector according to claim 1, wherein the mechanical safety means mechanically blocks an entry of the male electrical connector into the female electrical connector.

* * * * *